United States Patent [19]

Allara et al.

[11] 4,095,578

[45] Jun. 20, 1978

[54] INDUCTION CONDUITS OF INTERNAL COMBUSTION ENGINES

[75] Inventors: Giuseppe Allara, Nichelino (Turin); Giorgio Marchetti, Regina Margherita-Collegno (Turin), both of Italy

[73] Assignee: Fiat Societa per Azioni, Turin, Italy

[21] Appl. No.: 719,291

[22] Filed: Aug. 31, 1976

[30] Foreign Application Priority Data

Dec. 24, 1975 Italy ..... 70183 A/75

[51] Int. Cl.[2] ..... F01L 3/00

[52] U.S. Cl. ..... 123/188 M; 123/191 R; 123/30 C

[58] Field of Search ..... 123/30 C, 188 M, 191 R, 123/191 M, 193 R, 193 CH, 193 H

[56] References Cited

U.S. PATENT DOCUMENTS

| | | | |
|---|---|---|---|
| 1,903,159 | 3/1933 | Asbury | 123/191 M |
| 3,274,981 | 9/1966 | Peras | 123/191 M |
| 3,868,940 | 3/1975 | Kirchweger | 123/188 M |
| 3,884,209 | 5/1975 | List | 123/188 M |
| 3,933,142 | 1/1976 | List | 123/188 M |
| 3,945,363 | 3/1976 | Elsbett | 123/188 M |

FOREIGN PATENT DOCUMENTS

| | | | |
|---|---|---|---|
| 1,261,486 | 4/1961 | France | 123/188 M |
| 2,308,327 | 10/1973 | Germany | 123/188 M |
| 145,061 | 12/1920 | United Kingdom | 123/193 H |

*Primary Examiner*—Ronald H. Lazarus
*Attorney, Agent, or Firm*—Sughrue, Rothwell, Mion, Zinn and Macpeak

[57] ABSTRACT

An induction conduit in an internal combustion engine cylinder head is formed with an appendage of rectangular section extending parallel to the axis of a valve stem at the end of the conduit adjacent the valve seat and disposed in a radial plane inclined to the transverse axis of the valve parallel to the engine shaft at an angle of between 0° and 45° to assist in reducing the turbulence in the inducted air due to centrifugal motion. The lower face of the appendage can be machined to regulate the degree of turbulence.

2 Claims, 2 Drawing Figures

INDUCTION CONDUITS OF INTERNAL COMBUSTION ENGINES

The present invention relates to improvements in the induction conduits of internal combustion engines, particularly, diesel engines, aimed at facilitating control during manufacture of the degree of turbulence of the induction air with a view to improving the overall efficiency of an engine and, in particular, reducing the smoke present in the exhaust gases.

In most cases, in order to obtain optimum performance of an engine, upon which the degree of turbulence of the air flowing into the combustion chambers of the engine has a considerable influence, it is necessary to carry out adaptation and smoothing operations on the walls of the induction conduits with the specific purpose of rendering uniform the turbulence in all the cylinders of an engine or a series of engines of a given type.

Operations of this type, particularly in diesel engines for the purpose of controlling smokiness in the engine exhaust gases, entail considerable cost and technical difficulty.

The object of the present invention is to provide an improved induction conduit in a cylinder head of a diesel cycle reciprocating internal combustion engine, capable of influencing the degree of turbulence of the air drawn into the engine while at the same time having a shape and position such as will facilitate, by simple machining operations, control of the degree of turbulence of the air issuing from the induction conduit, rendering it possible at reasonable cost, especially in mass production, to build engines which exhibit a uniform turbulence for all the cylinders.

According to the invention there is provided an induction conduit for internal combustion engines, in which the conduit terminates in a valve seat with which a valve cooperates, the wall of the induction conduit in the vicinity of the valve seat having an appendage projecting into the interior of the conduit and disposed in a radial plane with respect to the longitudinal axis of the valve, the appendage being delimited laterally by a first surface substantially parallel to the longitudinal axis of the valve and delimited at its end facing the valve seat by a second surface substantially orthogonal to the first, the said second surface being capable of being subjected to machining operations for the removal of material to control the degree of turbulence caused by the appendage in the air flowing through the conduit in use thereof.

It is possible by means of the invention to control the degree of turbulence in the induction conduit, and therefore the degree of smokiness of the engine exhaust, simply by controlling the size of the appendage by means of machining operations.

Figure 1:
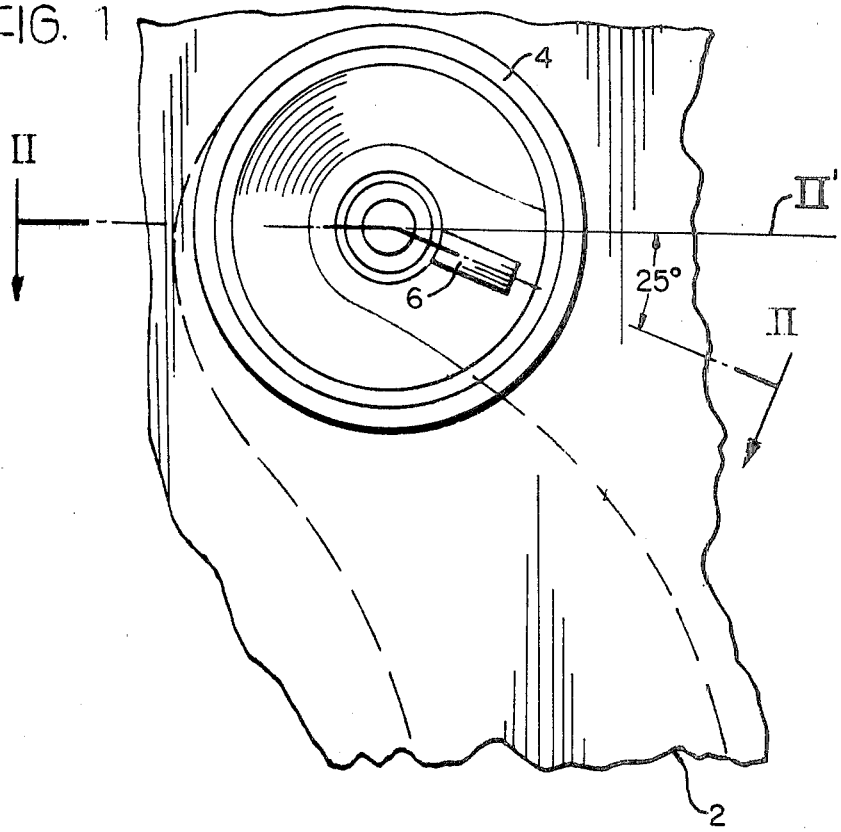
Figure 2:
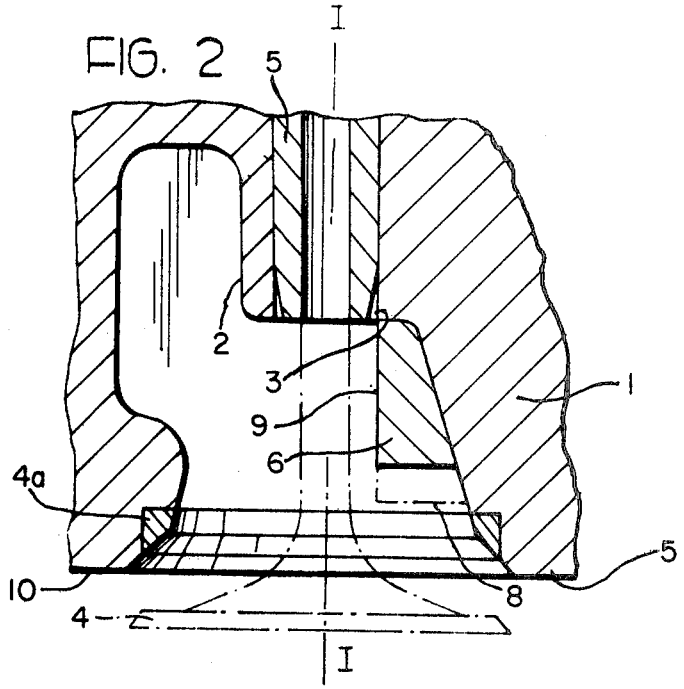

The invention will be further described, by way of non-limiting example, with reference to the accompanying drawings, in which:

FIG. 1 is a schematic plan view of part of an induction conduit according to one embodiment of the invention, and FIG. 2 is a cross section taken on the line II—II of FIG. 1.

With reference to the drawings, reference numeral 1 indicates schematically part of a cylinder head of an engine in which are provided an induction conduit 2 of volute shape and a hole 3 for the passage of a stem of a valve 4. A valve guide 5 is fitted tightly into the hole 3 to guide the valve stem for reciprocating movement.

The valve 4 cooperates with a valve seat 4*a* disposed at one end of the induction conduit 2.

Part of the conduit 2 adjacent the valve seat is formed upon casting of the cylinder head with an appendage 6 of rectangular cross section, disposed in a radial plane with respect to the longitudinal axis of the valve 4, this plane being inclined at an angle between 0° and 45°, preferably between 0° and 25° to the transverse axis II' of the valve which is parallel to the axis of the engine shaft, not shown in the drawings. The precise angular position of the appendage 6 can be accurately determined on a model or test engine during preliminary tests and during the tuning of the engine.

The appendage 6 is delimited at its lower end, that is, its end adjacent the engine cylinder, by a surface 8 and laterally by a surface 9, orthogonal to the surface 8, substantially parallel to the axis I—I of the valve stem, which is vertical as shown in FIG. 2.

A conventional volute type induction conduit 2 causes, under normal flow conditions, the greater part of the air turbulence in the end part of the induction conduit 2, before the air enters the cylinder. The appendage 6 has the effect of suddenly interrupting part of the jet of air passing through the valve 4 with a centrifugal motion and thereby affects a reduction in the turbulence of the inducted air. The greater the height of the appendage 6, that is, its dimension parallel to the valve stem axis, the greater will be the reduction of the air turbulence.

The reduction in the turbulence of the inducted air to achieve a desired degree of smokiness in the engine exhaust gases can be controlled during the manufacture and the tuning of the engine. Thus material is removed, by suitable tools, from the appendage 6 in correspondence with the surface 8, until the height of the appendage 6 is such as to cause a degree of turbulence corresponding to the optimum value established during the tuning of the engine or the engine model. This operation can be carried out under fluid-dynamic control on bed jigs which determine the height of the appendage 6, and, consequently, the required degree of turbulence. For example, in one specific case the height of the appendage 6 measured from the face 10 of the head was variable from a minimum of 15 to a maximum of 30 millimeters.

We claim:

1. In a cylinder head for an internal combustion engine including a valve seat, a valve guide and a valve cooperating with the valve guide and valve seat, an induction conduit terminating in the valve seat and including, in the wall of the induction conduit intermediate the valve guide and the valve seat, an appendage projecting into the interior of the conduit and disposed in the radial plane with respect to the longitudinal axis of the valve, said radial plane being inclined at an angle of between 0° and 45° to the transverse axis of the valve parallel to the axis of the engine shaft and the appendage, in plan view having a rectangular cross sectional shape, being delimited laterally by a first surface substantially parallel to said longitudinal axis of the valve and delimited at its end facing the valve seat by a second surface substantially orthogonal to the first, the said second surface being machinable for the selective removal of material to control the degree of turbulence caused by the appendage in the air flowing through the conduit in use thereof.

2. The induction defined in claim 1, wherein the radial plane in which the appendage is disposed is inclined at an angle of between 0° and 25° to the transverse axis of the valve parallel to the axis of the engine shaft.

* * * * *